United States Patent [19]

Dinkelkamp et al.

[11] 4,013,053

[45] Mar. 22, 1977

[54] FUEL PUMP

[75] Inventors: Henry T. Dinkelkamp, Mount Prospect; Bryce W. Carus, Grayslake; Robert J. Norman, Elmhurst, all of Ill.

[73] Assignee: Stewart-Warner Corporation, Chicago, Ill.

[22] Filed: May 2, 1975

[21] Appl. No.: 573,810

[52] U.S. Cl. ..... 123/136; 123/138; 123/139 AU; 417/199 A; 417/200

[51] Int. Cl.[2] ..... F02M 39/00

[58] Field of Search ..... 123/136, 139 AU, 138; 417/199 A, 200, 201

[56] References Cited

UNITED STATES PATENTS

| | | | |
|---|---|---|---|
| 1,760,313 | 5/1930 | Morgan | 417/200 |
| 1,860,688 | 5/1932 | Muzzy | 417/200 |
| 3,591,316 | 6/1971 | Piccirilli | 417/200 |
| R16,406 | 8/1926 | Barton | 417/200 |

FOREIGN PATENTS OR APPLICATIONS

| | | | |
|---|---|---|---|
| 777,235 | 2/1935 | France | 417/200 |
| 664,939 | 9/1938 | Germany | 417/200 |

*Primary Examiner*—Ronald B. Cox

[57] ABSTRACT

An electric-motor-powered centrifugal fuel pump including a vacuum control device to achieve the initial priming of the centrifugal pump. The electric motor which drives a centrifugal impeller is housed within the pump itself and, as such, is immersed in the fuel being pumped. An associated filter bowl incorporates a float valve, thus becoming a filter and float bowl which controls the vacuum so that when the fuel level reaches a predetermined point, the float valve rises and engages its valve seat, thus shutting off the vacuum source. A secondary ball valve is also provided in the vacuum line so that, in the event of the vehicle's overturning, this ball valve will close the vacuum line and prevent gravitational fuel flow to the vacuum source. When the vacuum draws sufficient fuel into the centrifugal pump cavity, the centrifugal impeller is then capable of discharging this fuel under pressure through the filter to an outlet port that is connected to the carburetor. Furthermore, once the centrifugal impeller is so primed, it will sustain the prime. A check valve is provided in the fuel suction line to prevent gravitational draining of the pump during shutdown.

5 Claims, 11 Drawing Figures

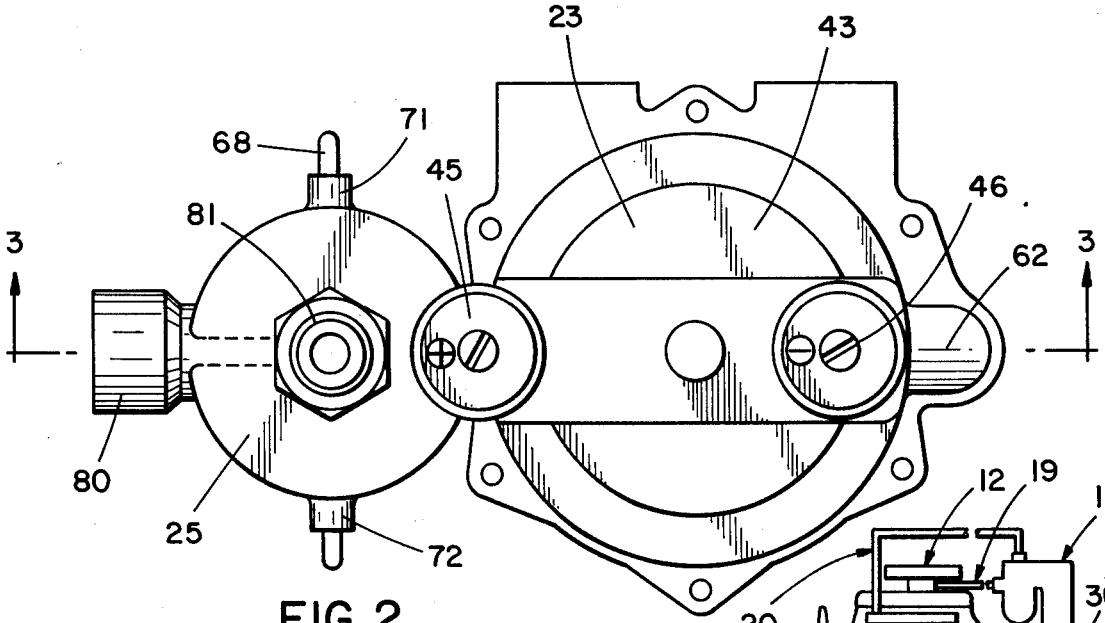
FIG. 2
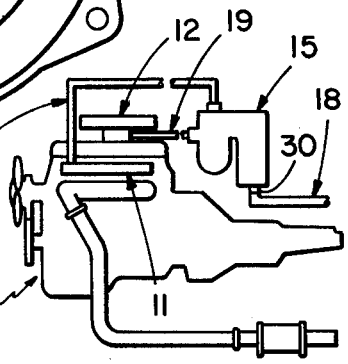
FIG. 1
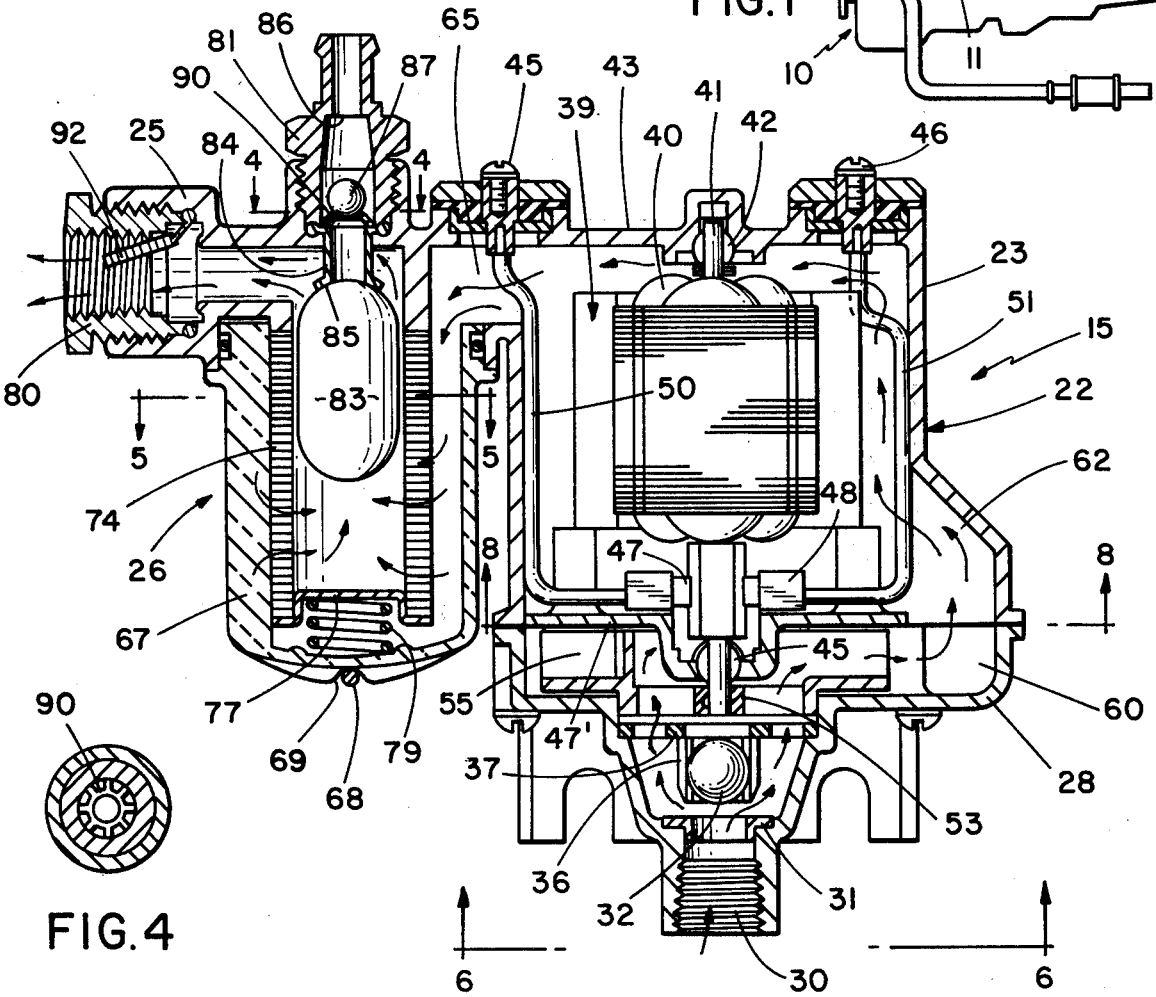
FIG. 4
FIG. 3

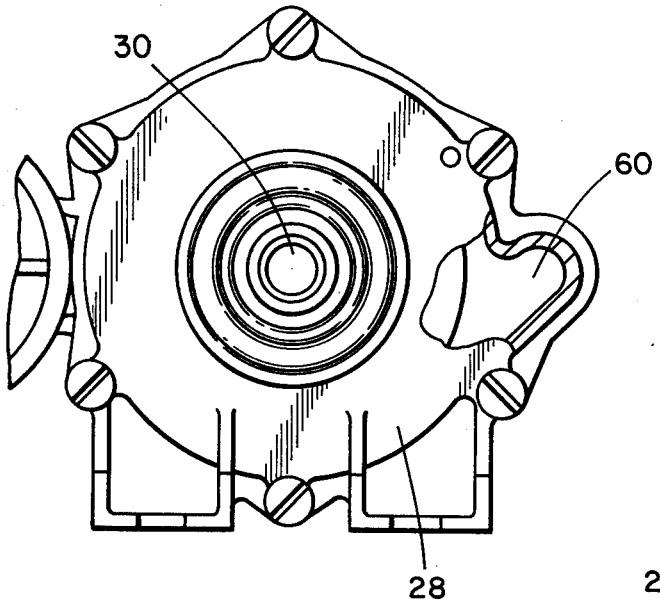
FIG.6
FIG.5
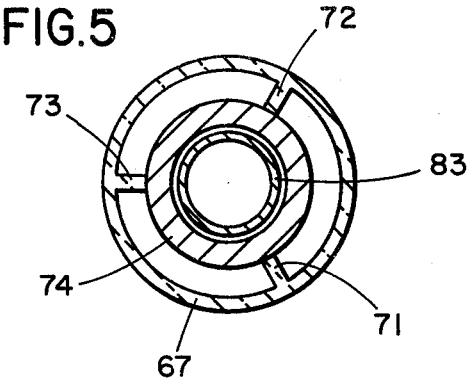
FIG.7
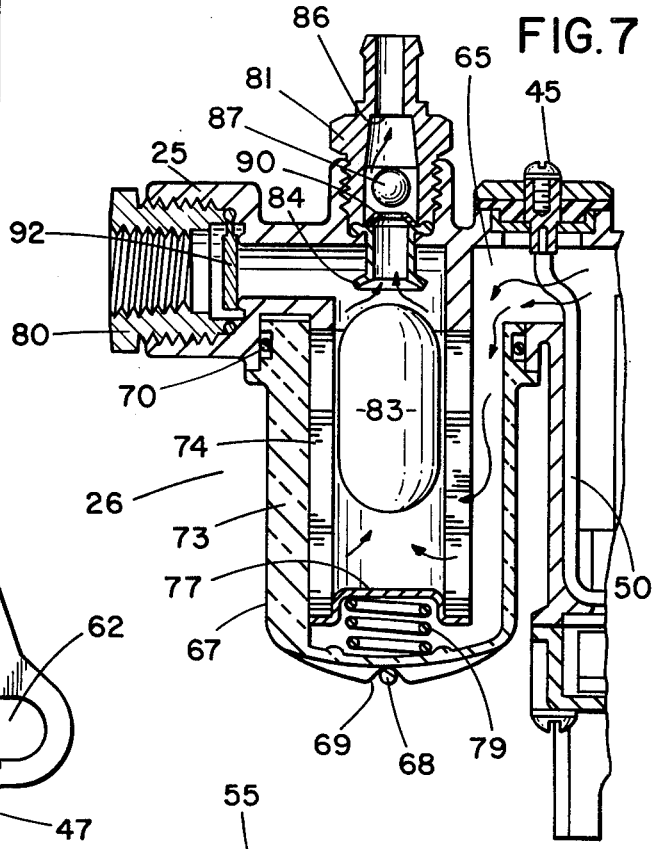
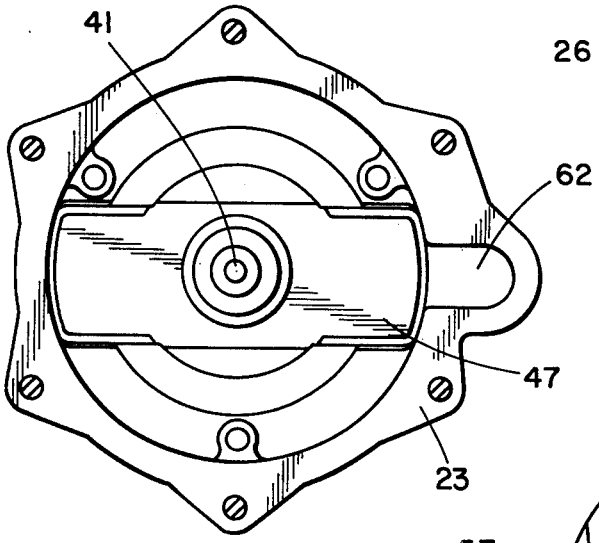
FIG.8
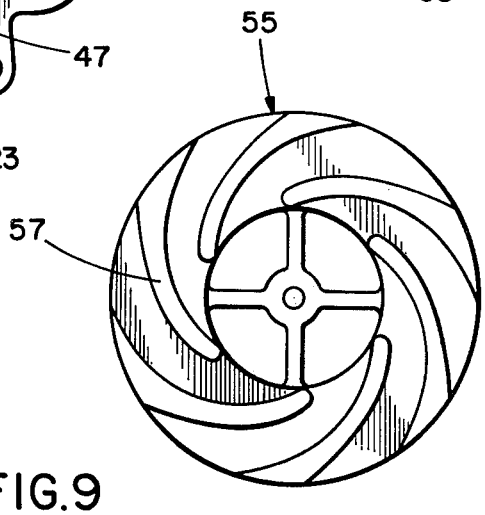
FIG.9

110
111
112
113
115
117
118
119
120
121
122
123
124
126
128
130
131
132
136
137
139
140
141
142
143
145
146
147
148
150
151
153
155
156
157
160
162
167
168
169
170
171
172
174
177
179
180
181
183
184
185
186
187
190

FUEL PUMP

BACKGROUND OF THE INVENTION

A plurality of various types of fuel pumps have been employed to convey liquid fuel from the vehicle's storage tank to the carburetor of an internal combustion engine. Engine-driven mechanical fuel pumps are — for all practical purposes — located in proximity to the engine and remote from the fuel storage tank; therefore, a lengthy suction line must be provided from the pump to the tank. Long suction lines require high vacuum to achieve the desired flow rate and therefore subject the fuel to lower pressures resulting in greater vaporization of the fuel which, in turn, causes "vapor lock" under adverse conditions. Electrically powered fuel pumps have the advantage of being installed in, or close to, the fuel storage tank, thus requiring a minimum length of suction line which greatly reduces the possibility of vapor lock.

Another advantage of an electric fuel pump is that it supplies fuel to the carburetor before the engine is cranked, thus providing faster starting under adverse conditions.

Prior to this invention, all electrically powered fuel pumps that are mounted outside the fuel tank must, of necessity, be self-priming. Only positive displacement pumps such as gear, vane, or piston pumps are self-priming. Positive displacement pumps rely upon closely fitted parts in order to effect a suction prime. Because of this, they are subjected to extensive wear and subsequent short life. Furthermore, additional means must be provided to cope with the discharge of a positive displacement pump when the demand is less than the output of the pump. In other words, positive displacement pumps, of themselves, are not demand responsive.

Although centrifugal pumps were used prior to this invention, such applications require in-the-tank installation. In other words, the entire pump was submerged in the fuel. Such applications require specialized fuel tanks and, therefore, are practical only when employed by the original vehicle manufacturer.

SUMMARY OF THE PRESENT INVENTION

In accordance with the present invention, a centrifugal pump is provided for a vehicular engine, which pump can be installed outside of the fuel tank. This centrifugal pump, not requiring close fitting dimensions, will provide long service life as its performance is not appreciably affected by wear. Furthermore, centrifugal pumps by their inherent characteristics are demand-responsive, i.e., no outside means must be employed to regulate the discharge volume when the demand is less than the maximum output of the pump.

An important feature of the present invention is that the centrifugal pump is self-priming. A float bowl formed integrally with the pump is connected to a source of vacuum such as the engine intake manifold. This vacuum source draws fuel through the pump impeller and into the float bowl itself. After a predetermined level of fuel is reached in the float bowl, a float valve member closes the vacuum fitting to the engine intake manifold and fuel flows through an outlet in the float bowl to the engine carburetor.

A ball valve is also provided in the vacuum fitting for the purpose of preventing fuel flow into the engine intake manifold upon the chance that the vehicle overturns with the fuel pump running, and this of course is a safety feature.

In a further embodiment of the present invention, a pumping assembly is provided positioned remotely from the engine adjacent the gas reservoir. A priming assembly is remotely located adjacent the engine carburetor although similar to the float bowl priming assembly described above. This has several advantages including the design combinations of priming assembly the pump assembly to meet the requirements of any particular application. Moreover, by separating the pump assembly from the priming assembly and isolating the pump from the heat in the engine compartment, the possibility of vapor lock and cavitation in the pump are reduced.

BRIEF DESCRIPTION OF THE DRAWINGS

FIG. 1 is a schematic view of an internal combustion engine with the present fuel pump illustrated schematically;

FIG. 2 is a top view of the present fuel pump;

FIG. 3 is a cross-section taken generally along line 3—3 of FIG. 2;

FIG. 4 is a cross-section taken generally along line 4—4 of FIG. 3 illustrating the retainer for the ball valve;

FIG. 5 is a cross-section taken generally along line 5—5 of FIG. 3 illustrating the float bowl;

FIG. 6 is a fragmentary bottom view of the fuel pump according to the present invention;

FIG. 7 is a view of the float bowl during the time the float valve is unseated;

FIG. 8 is a cross-section taken generally along line 8—8 of FIG. 3 illustrating the back shroud for the pump;

FIG. 9 is a subassembly view of the centrifugal pump impeller according to the present invention;

DETAILED DESCRIPTION OF THE PREFERRED EMBODIMENT

Figures 10, 11:
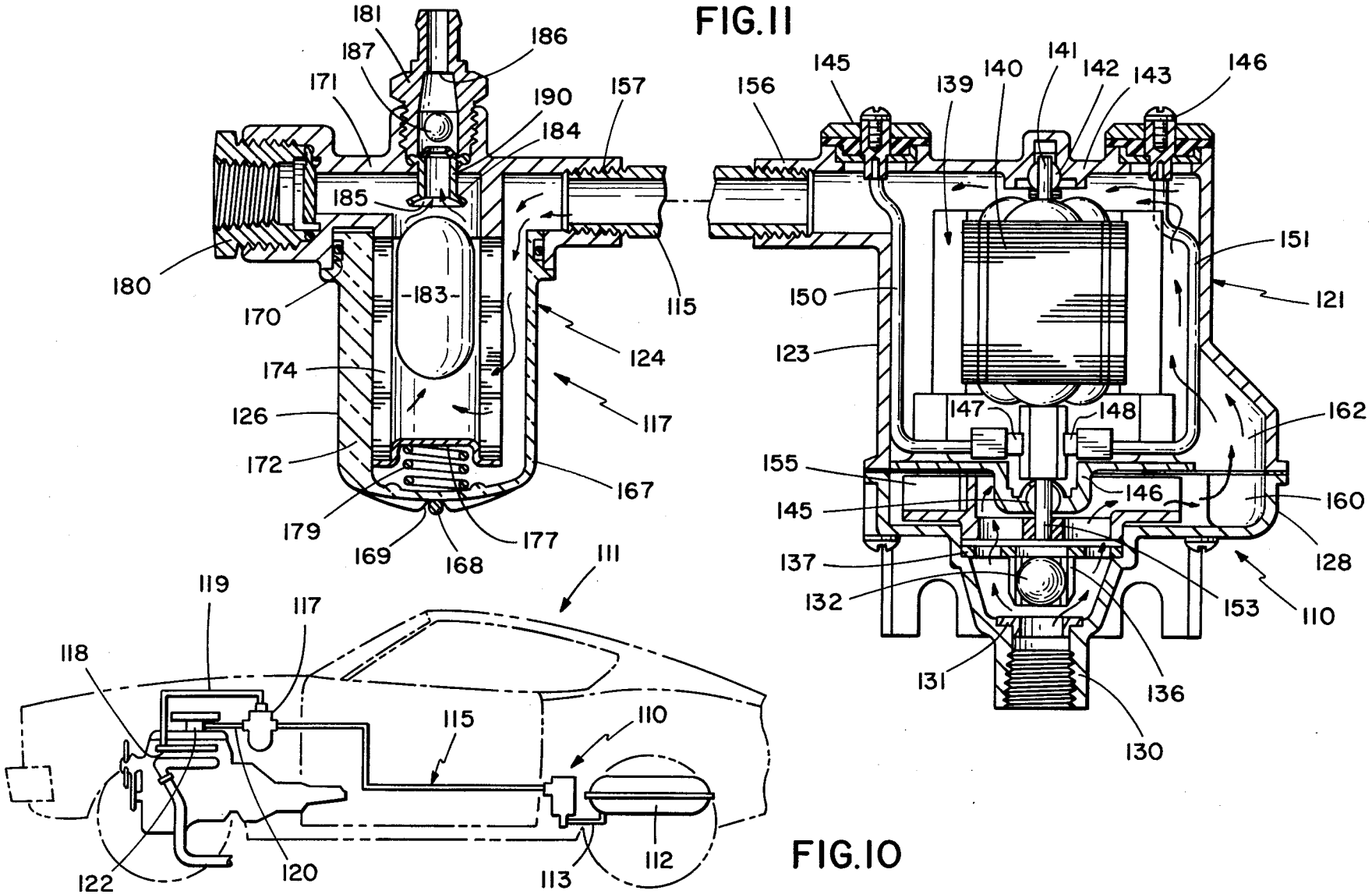
FIG. 10 is a schematic view of another embodiment of the present invention.
FIG. 11 is an elongated cross-section of the embodiment shown in FIG. 10.

Referring to the drawings and particularly FIG. 1, an internal combustion engine 10 is illustrated having an intake manifold 11 and a carburetor 12 all shown in rather general form.

There is provided, according to the present invention, a fuel pump 15 having an inlet connected to the fuel tank (not shown) through passage 18 and an outlet connected to deliver fuel through line 19 to the carburetor of the engine 10. The fuel pump 15 is an electrical fuel pump as will appear hereinafter with a centrifugal pumping action with the pump being primed by a vacuum in the pump outlet connected through passage 20 to the intake manifold of the engine.

Reference will now be made to the remaining figures for more detailed description of the fuel pump itself. Referring to FIG. 3, fuel pump 15 is seen to include a housing 22 consisting of a generally cylindrical main housing portion 23 and a parallel adjacent cylindrical interconnected integral housing portion 25 that defines a portion of a float bowl 26 which serves the purpose of priming the pump itself.

The housing at 22 also includes a cylindrical bottom cap 28. The bottom cap 28 has an inlet fitting 30 adapted to be connected to a fuel supply, and an inlet valve seat 31 for the purpose of seating a check valve 32 to prevent reverse flow of fuel.

A cage assembly 36 is provided on apertured plate 37 for the purpose of holding cage 36 and providing an inlet to the pumping elements themselves.

A motor 39 is provided in main housing 23 and has a rotor 40 with an associated drive shaft 41 seated in spherical bearing 42 in upper portion 43 of housing member 23 and a second lower spherical bearing 45 seated in a backshroud plate 47′ fixed within the housing member 23.

Current is provided to the motor 39 through terminal assemblies 45 and 46 connected to brushes 47 and 48 through lead lines 50 and 51.

Keyed to the lower end of drive shaft 41 as indicated at 53 is the centrifugal impeller 55 which is shown more clearly in FIG. 9. Impeller 55 has arcuate blade elements 57 of conventional construction.

The housing 23 defines the outlet for the centrifugal impeller 55 and also defines the flow passage for fuel flowing from the impeller to the float bowl 26. More particularly, an outlet scroll 60 shown in FIGS. 3 and 6, is provided in lower housing member 28, and a communicating projecting portion 62 is provided in housing member 23 as shown in both FIG. 3 and 8. Thus fuel flows from the impeller 55 through outlet scroll 60, passage 62, through the interior of the motor housing 23 and from there through a passageway 65 in the upper end of the housing 23 communicating with the float bowl 26.

The float bowl 26 includes a cup-shaped lower housing member 67. It is releasably retained in position by a U-shaped wire 68 which is snapped into a groove 69 in the lower end of the housing for the purpose of holding the cup 67 against an annular seat 70 on the float bowl portion 25. As seen in FIG. 2, the wire 68 is pivotable in bosses 71 and 72 integral with the upper housing portion 25 of the float bowl 26 so that bowl 26 may be removed for repair and replacement of cartridge 74 as well as the other elements in bowl 26.

As seen in FIG. 5, the lower member 67 of the float bowl 26 has three vertical flanges 71, 72 and 73 for the purpose of retaining the annular filter cartridge 74 in position. The cartridge is urged upwardly by a combined retainer and spring seat 77 which is urged upwardly by a spring 79 seated in the bottom of the cup 67.

For the purpose of priming the pump by drawing fuel through the impeller and to outlet fitting 80, a vacuum fitting 81 is provided adapted to be connected to line 20 which as described above communicates with the intake manifold of the engine 10. This draws fuel through the inlet 30, through the impeller 55, up through the main housing 23 and into the float bowl section 87 for the purpose of priming the pump.

To prevent fuel from floating into the intake manifold 11 as the float bowl 67 fills during priming, an oblong float valve 83 is provided which selectively seats on a valve seat 84 having an arcuate seating surface 85. The filter 74 serves as a guide for the float valve 83 which is shown in FIG. 3 in its closed position which indicates full fuel flow from the pump and a filled condition for the float bowl 67.

The vacuum fitting 81 has a second valve seat 86 with a ball valve 87 therein so that if the vehicle overturns with the electric fuel pump 15 running, the ball valve 87 will rest on seat 86 and prevent fuel flow to the manifold 11 since float valve 83 is incapable of this limited function. The ball valve 87 has a cage member 90 which is slotted as shown in FIG. 4 which holds the ball valve 87 in its normal position.

In operation, and prior to starting engine 10 the float valve 83 is in its lowermost position. When the ignition is turned on, motor 39 begins turning rotating impeller 53 which under these conditions would not be primed. As the engine turns and a vacuum is created in intake manifold 11, a vacuum is applied at fitting 81 which freely communicates through passage 65, the interior of housing 22, passage 62, outlet scroll 60, open impeller 55, with the inlet 30 of the pump, and in this manner fuel is drawn into the pump and into the float bowl 67. As fuel is drawn into the float bowl, float valve 83 rises until it engages valve seat 85 at which time the pump is fully primed and impeller 55 is completely capable of delivering fuel through the housing 23, passage 65 and out the outlet 80 delivering fuel to carburetor 12.

A circular rubber check valve 92 is provided for preventing reverse flow from the carburetor bowl to the fuel pump, particularly in installations when the fuel pump is mounted below the carburetor. Valve 92 is shown in its open position in FIG. 3 and its closed position in FIG. 7.

In FIGS. 10 and 11, a further embodiment of the present invention is illustrated wherein a pump assembly 110 is positioned in vehicle 111 adjacent gas tank 112, at the rear of vehicle 111. Pump 110 draws fuel through line 113 from tank 112 and conveys it through line 115 to priming assembly 117. The priming assembly 117 receives a source of vacuum from engine manifold 118 through line 119 in a manner similar to the FIGS. 1 through 9 embodiment. Priming assembly 117 has outlet tubing 120 connected to engine carburetor 122 for delivering fuel to the engine.

There are several advantages in separating the pump assembly 110 from the priming assembly 117. Firstly, the pump assembly 110 can be sold without the priming device. The priming assembly 117 thereby reduces the cost of the pump. Secondly, the pump and primer can be matched as desired depending upon the requirements of a particular internal combustion engine.

With the pump mounted adjacent the gas tank and the primer mounted near the intake manifold, the requirement for a long vacuum line 119 is eliminated. Furthermore, by separating the pump from the priming assembly and isolating the pump from the heat in the engine compartment, the possibility of vapor lock and cavitation in the pump is reduced.

Referring more particularly to the details of the separate pump and priming units illustrated in FIG. 11, fuel pump assembly 110 includes a housing 121 consisting of a generally cylindrical housing portion 123. Remote priming assembly 117 also has a housing 124 defining a float bowl 126 which serves the purpose of priming the pump itself.

The housing 121 also includes a cylindrical bottom cap 128. The bottom of the cap 128 has an inlet fitting 130 adapted to be connected to the fuel supply line 113, and an inlet valve seat 131 for the purpose of seating a check valve 132 to prevent the reverse flow of fuel. A cage assembly 136 is provided on apertured plate 137 for the purpose of holding cage 136 and providing an inlet to the pumping elements themselves.

A motor 139 is provided in the main housing 121 and has a rotor 140 with an associated drive shaft 141 seated in spherical bearing 142 in upper portion 143 of housing 121 and a second lower spherical bearing 145 seated in back-shroud plate 146 fixed within the housing 121.

Current is supplied to the motor 139 through terminal assemblies 145 and 146 connected to brushes 147 and 148 through lead lines 150 and 151.

Keyed to the lower end of drive shaft 141 as indicated at 153, is a centrifugal impeller 155. Impeller 155 has arcuate blade elements similar to impeller 155 illustrated in the FIGS. 1 through 9 embodiment.

The housing 121 defines the outlet for the centrifugal impeller 155 and also defines the flow passage for fuel flowing from the impeller to outlet fitting 156. Outlet fitting 156 is connected to inlet fitting 157 of the priming assembly 117 by line 115 illustrated in both FIGS. 10 and 11.

An outlet scroll 160 is provided in the lower housing member 128 and a communicating projecting portion 162 is provided in the housing member 123. Thus fuel flows from the impeller 155 through outlet scroll 160, portion 162, through the interior of the motor housing 121 and from there to outlet fitting 156, through passage 115 to the float bowl 126.

The float bowl 126 includes a cup shaped lower housing member 167. It is releasably retained in position by a U-shaped wire 168 which is snaped into a groove 169 in the lower end of the housing, for the purpose of holding the cup 167 against an annular seat 170 on the float bowl portion 171.

The lower member 167 of the priming assembly 117 has vertical flanges 172 for the purpose of retaining an annular filter cartridge 174 in position. The cartridge is urged upwardly by a retainer and spring seat 177 which is urged upwardly by a spring 179 seated in the bottom of the cup 167.

For the purpose of priming the pump by drawing fuel through the impeller to outlet fitting 180, a vacuum fitting 181 is provided adapted to be connected to line 119 which, as described above, communicates with the intake manifold 118 of the engine. This draws fuel through the inlet 130, through the impeller 155, up through the main housing 121 and into the float bowl cup 167 for the purpose of priming the pump.

To prevent fuel from flowing into the intake manifold as the float bowl 126 fills during priming, an oblong float valve 183 is provided which selectively seats on a valve seat 184 having an arcuate seating surface 185. The filter 174 serves as a guide for the float valve 183.

The vacuum fitting 181 has a second valve seat 186 with a ball valve 187 therein so that if the vehicle overturns with the fuel pump 110 running, the ball valve 187 will rest on seat 186 and prevent fuel flow to the manifold 118, inasmuch as the float valve 183 is incapable of this limited function. The ball valve 187 has a cage member 190 which is slotted as shown in the embodiment in FIG. 4

What is claimed is:

1. A fuel pump assembly, comprising; housing means, motor means connected in said housing means, inlet means in the bottom of said housing means beneath said motor means, a centrifugal pump in said housing means between said motor means and said inlet means, said housing means defining a float bowl, said centrifugal pump having an outlet connected to said float bowl so that the pump delivers fuel to said float bowl, a vacuum fitting at the upper end of said float bowl and having a vacuum fitting valve seat, a float valve member movable in said float bowl and engageable with said valve seat to prevent flow of fuel to said source of vacuum, an outlet passage in said float bowl adapted to be connected to a carburetor, said float bowl having a filter cartridge therein and said float valve member being slidable in said filter cartridge.

2. A fuel pump assembly as defined in claim 1, wherein said housing means has a removable portion defining said float bowl. and wire means releasably holding said removable portion in position.

3. A fuel pump assembly, comprising; housing means, motor means connected in said housing means, inlet means in the bottom of said housing means beneath said motor means, a centrifugal pump in said housing means between said motor means and said inlet means, said housing means defining a float bowl, said centrifugal pump having an outlet connected to said float bowl so that the pump delivers fuel to said float bowl, a vacuum fitting at the upper end of said float bowl and having a vacuum fitting valve seat, a float valve member movable in said float bowl and engageable with said valve seat to prevent flow of fuel to said source of vacuum, an outlet passage in said float bowl adapted to be connected to a carburetor, said vacuum fitting having an additional valve seat, and a ball valve in said vacuum fitting for preventing flow to said vacuum source upon rotation of the entire pump assembly.

4. A fuel pump for an internal combustion engine, comprising housing means having a first cylindrical portion, inlet means in the bottom of said first cylindrical portion, an inlet check valve in said inlet for preventing reverse fuel flow from said inlet means, a centrifugal pump impeller rotatably mounted in said inlet in said first cylindrical portion, said first cylindrical portion defining an outlet scroll for said centrifugal impeller, an electric motor in said first housing portion connected to drive said impeller, said motor being submersible in fuel from said outlet scroll, said housing having a second cylindrical portion adjacent said first cylindrical portion and internally connected to receive fuel therefrom; said second housing portion defining a float bowl, a vacuum fitting at the top of the float bowl adapted to be connected to the intake manifold of an internal combustion engine, said vacuum fitting having a first valve seat, a float valve in said float bowl engageable with said first valve seat to block fuel flow out said vacuum fitting when the pump is primed, an outlet fitting adjacent said vacuum fitting and adapted to be connected to an engine carburetor, a second valve seat in said vacuum fitting, and a ball valve engageable with said second valve seat to close said vacuum fitting upon rotation of the entire pump assembly.

5. A fuel pump assembly, comprising; housing means, motor means connected in said housing means, inlet means in the bottom of said housing means beneath said motor means, a centrifugal pump in said housing means between said motor means and said inlet means, said housing means defining a float bowl, said centrifugal pump having an outlet connected to said float bowl so that the pump delivers fuel to said float bowl, a vacuum fitting at the upper end of said float bowl and having a vacuum fitting valve seat, a float valve member movable in said float bowl and engageable with said valve seat to prevent flow of fuel to a source of vacuum, and an outlet passage in said float bowl adapted to be connected to a carburetor, said motor means being submersible, said housing means being formed to provide internal passage means through said motor means between said impeller and said float bowl.

* * * * *